US005878111A

United States Patent [19]

Schulz

[11] Patent Number: 5,878,111

[45] Date of Patent: Mar. 2, 1999

[54] X-RAY ABSORPTION FILTER HAVING A FIELD GENERATING MATRIX AND FIELD SENSITIVE LIQUIDS

[75] Inventor: Reiner-F Schulz, Dormitz, Germany

[73] Assignee: Siemens Aktiengesellschaft, Munich, Germany

[21] Appl. No.: 935,256

[22] Filed: Sep. 22, 1997

[30] Foreign Application Priority Data

Sep. 20, 1996 [DE] Germany ..... 196 38 6721.7

[51] Int. Cl.[6] ..... G21K 3/00

[52] U.S. Cl. ..... 378/158; 378/159

[58] Field of Search ..... 378/158, 159, 378/156, 157

[56] References Cited

U.S. PATENT DOCUMENTS

| | | | |
|---|---|---|---|
| 3,755,672 | 8/1973 | Edholm et al. . | |
| 5,559,853 | 9/1996 | Linders et al. | 378/159 |
| 5,625,665 | 4/1997 | Fokkink et al. | 378/159 X |
| 5,751,786 | 5/1998 | Welters et al. | 378/158 X |
| 5,768,340 | 6/1998 | Geittner et al. | 378/159 |

FOREIGN PATENT DOCUMENTS

| | | | |
|---|---|---|---|
| 2 601 493 | 1/1988 | France | 378/159 |
| 2159365 | 7/1972 | Germany . | |
| 4422780 | 1/1996 | Germany . | |

*Primary Examiner*—David P. Porta
*Attorney, Agent, or Firm*—Sughrue, Mion, Zinn, Macpeak & Seas, PLLC

[57] ABSTRACT

Filter (3) for absorbing X-rays (2), having a controllable field-generating matrix arranged on a housing (7). The matrix generates electric or magnetic fields acting on liquids (13, 14) located in the housing. The housing (7) has at least one first and one second chamber (9, 10) which are separated in a sealed fashion from one another by means of a flexible diaphragm (8). The first and second liquids (13, 14) are located in the first and second chambers (9, 10) respectively, and differ in their X-ray absorption characteristics. At least one of the liquids is a magneto-rheological or an electro-rheological liquid, depending on the type of matrix provided. In operation, a minimum pressure is applied to at least one of the liquids, and the localized fields produced by the matrix cause the liquids (13, 14) to alter their respective thickness ratios, to provide a an X-ray filter having location-specific absorption characteristics.

26 Claims, 1 Drawing Sheet

X-RAY ABSORPTION FILTER HAVING A FIELD GENERATING MATRIX AND FIELD SENSITIVE LIQUIDS

The following disclosure is based on German Patent Application No. 19638621.7, filed on Sep. 20, 1996, which is incorporated into this application by reference.

FIELD OF AND BACKGROUND OF THE INVENTION

The invention relates to a filter for absorbing X-rays. More particularly, the invention relates to an X-ray absorbing filter having a controllable matrix for generating a field acting on a liquid located in a housing. In addition, the invention is directed to an X-ray machine having such a filter for absorbing X-rays.

In X-ray examinations, the patient and his/her organs in the region to be examined often exhibit strongly differing absorption characteristics with respect to the X-rays applied. For example, for chest X-rays, the attenuation in the mediastinum (i.e., in the region in front of the pulmonary lobes) is very largely determined by the organs to be found there. In the region of the pulmonary lobe itself, by contrast, the attenuation is small. In order both to obtain an informative picture and, in particular, to spare the patient unnecessary exposure to radiation, it is sensible to set the applied dosage based on the characteristics of the region being examined, in such a way that no more X-rays than necessary are supplied. In other words, a larger dose should be applied in regions of large attenuation than should be applied in regions of low attenuation.

In addition, there are applications in which only a portion of the region to be examined need be recorded with high diagnostic quality, i.e. with little noise. The surrounding parts are important for orientation but not for the actual diagnosis. These surrounding regions could, then, be imaged with a smaller dose of radiation in order thereby to reduce the total dosage applied.

Such a filter is disclosed, for example, in German Laid-Open publication DE-A 44 22 780. This filter has a housing with a controllable electrode matrix that is used to generate an electric field. This field acts on a liquid in contact with the electrode matrix. Ions that absorb X-rays are present in this liquid. These ions move freely, and migrate as dictated by the applied field. Hence, by appropriately forming the field in the region of one or more electrodes, it is possible to accumulate a correspondingly large or small number of ions so as to change the local absorption behavior of the filter. However, the absorption profile that can thereby be achieved over the filter area, i.e. the attenuation pattern caused by ion accumulation, frequently does not provide effects which are satisfactory for specific applications in the fields of diagnosis and therapy. In addition, there is a further disadvantage in that the accumulation requires ions to migrate in the field. It requires a relatively long time in order to achieve a state of equilibrium, in which ion migration ceases. (The equilibrium state is a function of the field.)

OBJECTS OF THE INVENTION

It is therefore a first object of the invention to provide a filter which improves over the conventional art and overcomes the disadvantages described above. Another object of the invention is to provide an X-ray absorption filter that provides a diagnostically and therapeutically useful X-ray absorption profile. A further object of the invention is to provide an X-ray absorption filter having a faster response time than conventional filters.

SUMMARY OF THE INVENTION

The invention provides, in a filter of the above-mentioned type, that the housing has at least one first and one second chamber, which are connected to one another in a sealed fashion by means of a flexible diaphragm. First and second liquids, which differ in their X-ray absorption characteristics, are located in the chambers. At least one of these liquids is a magneto-rheological or electro-rheological liquid, and at least one is subjected to a minimum pressure. A matrix is provided for generating a magnetic or electric field, depending on the rheological liquid that is used. The force field generated is controlled through the matrix to have a localized effect on the rheological liquid, such that the thickness ratio of the different liquids located in the two chambers changes in response to and in accordance with the force field applied. Being flexible, the diaphragm changes shape to accommodate the modifications in thickness ratio of the liquids located on either side of the diaphragm.

Thus, the filter according to the invention is distinguished by the use of two liquids of different absorption behavior, whereby the one liquid absorbs X-rays more strongly, the other less so. In addition, at least one of these liquids is a rheological liquid, i.e. it changes its flow behavior or viscosity when a force field is applied. The force field is preferably either electric or magnetic, depending on whether the liquid is electro-rheological or magneto-rheological. The rheological property is due to particles contained in the liquid, which interact with the applied field and are correspondingly brought from their disordered arrangement into aligned positions that depend on the field direction. The magneto-rheological liquids are magnetizable particles, in particular paramagnetic ones; the particles which react to an electric field are appropriately displaceable dipoles. The change in viscosity is due to the interaction between the particles that occurs as a result of the magnetization or the displacement of charges of those particles. The stronger the interaction, the more difficult the mutual displacement of the particles becomes.

In other words, the field matrix can be used to generate a flow behavior that differs from location to location within the X-ray filter. As a result, depending on the minimum pressure, the diaphragm can be bent locally, specifically in regions of low viscosity. The particular advantage of this is that the liquid layers can be forced to selectively assume different thicknesses at different points of the diaphragm. As a result, a locally differing ratio of the strongly absorbing liquid to the weakly absorbing liquid can be set by the stratification of the two liquids. This, in turn, has the advantage of making it possible to influence and thus control the local X-ray absorption behavior. It has proven to be particularly expedient to the invention for both liquids to be rheological, since both then change their viscosity accordingly in the same region, which allows them to flow more easily into and out of this region.

The size of the filter according to the invention is preferably about 40×40 cm, but the invention is not limited to these dimensions. In order to ensure satisfactory inflow and outflow of a liquid with regard to this size, the invention also provides for each chamber preferably to be connected to a liquid reservoir. The point here is that, for example, if a field is present only in the middle third over the entire length of the filter, which would lead to a shift in volume, substantial quantities of liquid, i.e. volumetric reservoirs of liquid, are necessary in order to supply the needed amount of additional liquid, or to drain the other liquid.

On the one hand, the minimum pressure can be the hydrostatic pressure; by appropriately arranging the level of at least one liquid reservoir, this pressure can act on the liquid and thus on the diaphragm. However, should this not suffice, the invention further provides for a pump that directs the liquid and that is connected upstream of the chamber containing the liquid to which pressure is applied. This pump can be used to set the minimum pressure required for supplying the necessary quantities of liquid and, of course, for bending the diaphragm. Correspondingly, a further pump can also be connected upstream of the other chamber. When the field is no longer present, this pump is then used to return the liquid that has been pressed out, in order to reestablish the initial state.

It is advantageous for the local absorption behavior to be able to vary over the widest possible band. It has proven to be expedient in this regard to arrange the diaphragm so as to form two chambers of different size. According to a further embodiment, the liquid to which pressure is applied is arranged in the smaller chamber. By applying pressure to only one chamber and bending the diaphragm to a corresponding extent, this embodiment of the invention advantageously allows liquid conditions to be set in which the ratio is marked to a large extent by the first liquid in some regions, while in other regions it is marked by the second liquid, since the diaphragm can be bent just as far as appropriate.

The invention provides that the matrix can generate an electric field by means of pairs of electrodes. One electrode of each pair is assigned to the first liquid, and the other electrode is assigned to the second liquid. Within the scope of the invention, the matrix can alternatively generate a magnetic field by means of coils that are preferably assigned to the rheological liquid. However, the matrix can also be assigned to the second, possibly non-rheological liquid since—like the electric field—the magnetic field penetrates both liquids.

No matter what the embodiment, the matrix can be arranged on the filter so as to be spatially separate from the liquids, for example on the outsides of each respective chamber. Alternatively, the invention can provide for the respective electrodes or the coils to be in contact with the respective liquid so that, in this case, the selection of the chamber material is not restricted. If the matrix is arranged on the outside, the material used for the chamber should not be allowed to attenuate the field.

The invention can further provide that the electrodes or coils respectively in contact with one liquid are arranged in the shape of a network or grid with appropriate interspaces that permit liquid to pass. This allows the respective liquid to circulate between the reservoir and the actual chamber. This can be accomplished most expediently by arranging the electrodes or coils on a support provided with appropriate interspaces, in the form of, e.g., perforations.

Since the filter is placed near the X-ray machine, i.e., close to the focal point generating the X-rays, the invention further provides for the area of an electrode, or the area enclosed by the coil, to be less than 1 $cm^2$. Since the X-rays are projected onto the patient in the form of a fan, such a small dimensioning of the electrodes or the coils is desirable, to make it possible to tune the absorption behavior with adequate fineness as regards projection.

The invention also provides for the housing to consist of a material which shields the exterior of the filter from the field generated within the filter. This prevents external components, for example of an X-ray machine, from being influenced by the generation of the, albeit generally weak, field inside the filter.

The invention also relates to a medical X-ray machine comprising a filter of the type described above.

BRIEF DESCRIPTION OF THE DRAWINGS

The invention and further advantageous refinements of the invention according to the features of the dependent claims are explained in more detail below with the aid of diagrammatic, exemplary embodiments in the drawing, in which:

DETAILED DESCRIPTION OF THE PREFERRED EMBODIMENTS

Figure 1:
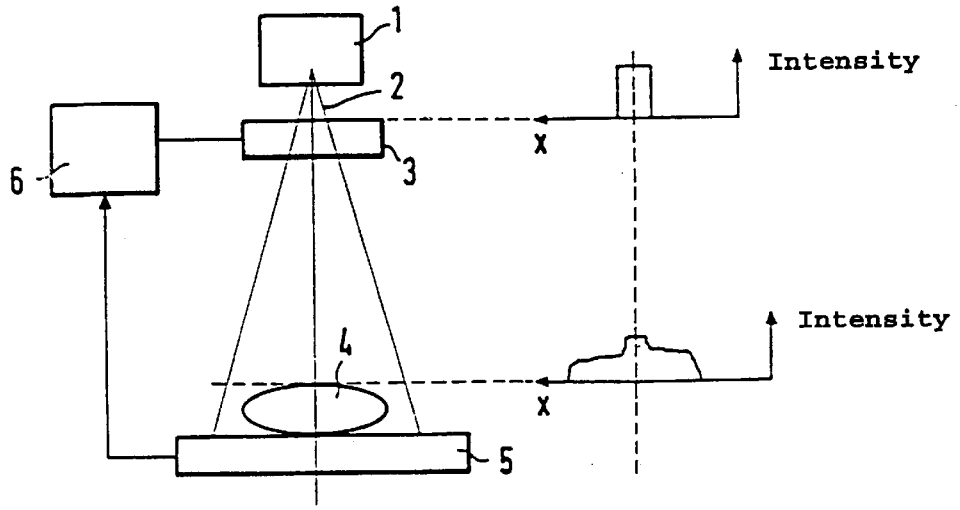
FIG. 1 shows a sketch for illustrating the principle of a medical X-ray machine provided with a filter according to the invention, and two intensity curves corresponding to different projection planes.

FIG. 1 shows a medical X-ray machine according to the invention in the form of a general schematic for illustrating the principle of the invention. Among the individual components shown is an X-ray source 1 which emits X-ray beams 2. Connected downstream of this X-ray source 1 is an adaptive filter 3 according to the invention. The X-rays 2 pass through the filter 3 and have their intensity characteristic modified depending on the absorption behavior of the filter 3, as explained in greater detail below. The X-rays 2 thereafter impinge upon an object 4, for example a patient, and are further modified in accordance with the absorption characteristics of the object 4. An X-ray detector 5 is connected downstream of the object 4. The X-ray machine also comprises a control device 6 for carrying out a variety of control and processing functions, including controlling a field-generating matrix of the filter 3.

FIG. 1 further shows two graphs. The location x is plotted along the abscissa, and the intensity of the X-rays 2 along the ordinate. The upper curve shows the local intensity distribution of the X-rays 2 in a region directly upstream of the filter 3. The curve is decidedly rectangular, i.e. the intensity is essentially (in an idealized system) constant over the entire width occupied by the X-rays in this region. After the filter 3 has been traversed, the intensity characteristic is changed, however, as shown in the lower graph. Without the filter 3, there ought to be a rectangular curve here as well, at least in an idealized system, with the area under the curve corresponding essentially to the area under the first rectangular curve. In the exemplary embodiment shown, however, the filter 3 has changed the intensity distribution with respect to the location. In the region of the middle of the beam, the intensity is substantially higher than in the outer regions. This means that the applied dose is larger in the central region than in the edge regions. Such an intensity distribution is desirable, e.g., for examining the spine. In this case, only the spine is to be imaged with high quality, whereas the edge regions serve only for orientation and therefore need not be imaged with high quality. In order to be able to set the absorption behavior of the filter 3 in accordance with appropriate specifications, it can be controlled as needed by the control device 6. The control device 6 also communicates with the X-ray detector 5 in order to use results obtained from a first picture, for example in the fluoroscopic mode of operation, to fix the control parameters accordingly so that the filter 3 can be set to produce the desired picture.

Figure 2:
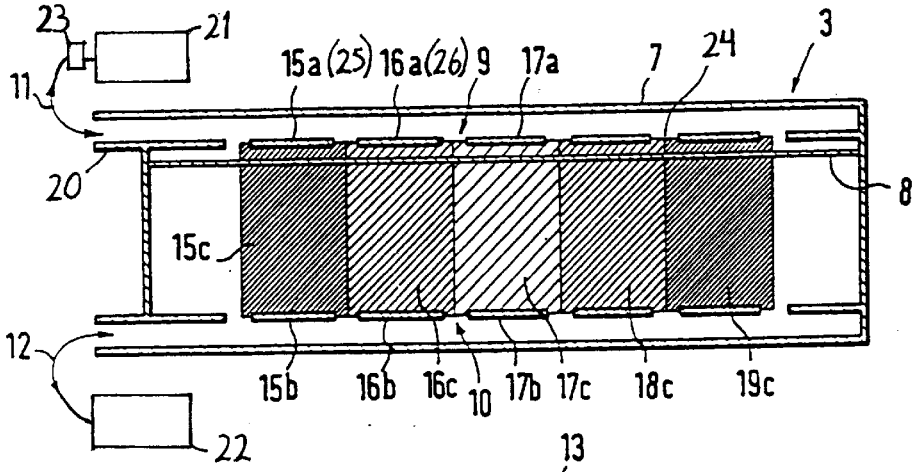
FIG. 2 shows a sectional view of a schematically illustrated filter according to the invention, and further depicting a field distribution shown by way of example.

FIG. 2 shows a section through the filter 3 according to the invention. The filter comprises a housing 7, which is separated into two chambers 9, 10 by a flexible diaphragm 8. Each of the chambers 9, 10 has an inlet or outlet 11 or 12, via which rheological liquid 13, 14 located in the chamber can be supplied or removed. Each inlet or outlet communicates with a reservoir 21, 22 for the respective liquid, provided for supplying or draining the liquid as appropriate, as described in more detail below. A liquid pump 23 for applying a minimum pressure to the liquid located in the chamber 9 is provided at least in the line departing from the inlet or outlet 11.

The filter 3 also includes several pairs of electrodes 15*a*, 15*b*, 16*a*, 16*b*, 17*a*, 17*b*, etc. which are arranged to form a matrix of electrodes. The respective electrodes 15*a*, 16*a*, 17*a*, etc. and 15*b*, 16*b*, 17*b*, etc. are spaced apart from one another, in order to form interspaces 24 between them so that the respective chamber liquid can circulate through them. FIG. 2 shows the electrodes spaced apart laterally, such that they lie in two essentially parallel planes. One or more supports 20, in the form of a substrate or the like, are provide for anchoring the electrodes 17–19. According to an alternative embodiment, the filter 3 is constructed using magnetic coils 25, 26, etc. for generating a locally variable magnetic field, instead of a locally variable electric field.

During operation, a field (an electric one in the example shown) is formed between each pair of electrodes 15*a*, 15*b*, etc., which is controlled as a function of control parameters fixed by the control device 6. This field is illustrated by the idealized, essentially rectangular, hatched regions 15*c*, 16*c*, 17*c*, 18*c* and 19*c*. The different hatching is intended to illustrate the corresponding field strength. For example, the respective fields can be adjusted by the control device 6 via the matrix of electrodes 15–19 to decrease in strength from the periphery (15*c*, 19*c*) inward (17*c*) in the example shown.

Figure 3:
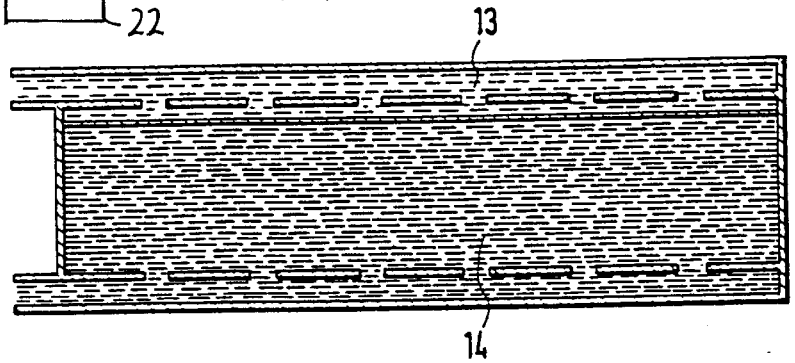
FIG. 3 shows a section through an exemplary filter as shown in FIG. 2, in a state in which no field is applied.

FIG. 3 shows a section through a filter in which no field is applied between the electrodes. The liquids 13, 14 are electro-rheological liquids in the exemplary embodiment shown. Their viscosity varies as a function of the applied electric field, i.e. the stronger the local field, for example, the higher the local viscosity of the liquid, and vice versa. Both liquids 13, 14 can be rheological ones, although it suffices for the purpose of achieving the objects of the invention if only one of the liquids is rheological. If the elements generating the field are not electrodes but rather coils generating a magnetic field, the chamber liquids are selected to be magneto-rheological ones, which change their viscosity as a function of the magnetic field applied.

If the field shown by way of example in FIG. 2 is applied to the filter 3 shown in FIG. 3, the effect is a local change in viscosity, which occurs in a matter of milliseconds, depending on the local field distribution. Since the lowest electric field is applied between the electrodes 17*a*, 17*b*, the viscosity of the liquids 13, 14 scarcely changes in this region. By contrast, in the bordering regions the viscosity increases as a consequence of the electric field respectively prevailing. The effect of this is to bend the flexible diaphragm 8 downwards in the central region, i.e. in the region of the electrodes 17*a*, 17*b*, as a consequence of the pressure acting on the liquid 13 via the inlet and outlet 11, since there is a more favorable flow behavior in this region as a consequence of the change in viscosity. The liquid 14 can likewise be pressed out of this central region substantially more easily, likewise owing to the applied minimum pressure.

Figure 4:
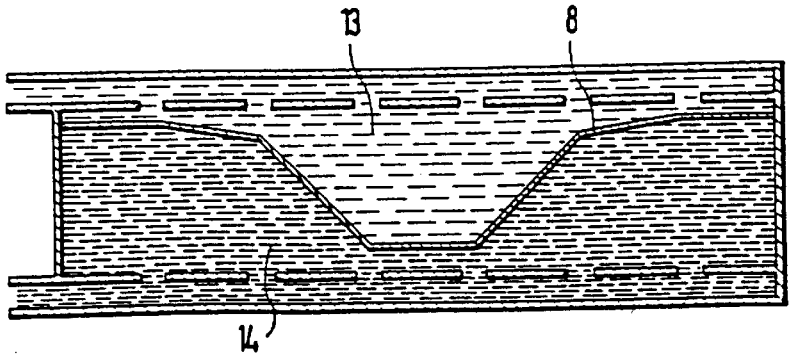
FIG. 4 shows a section through a filter constructed as shown in FIG. 3, to which a field distribution as specified by way of example in FIG. 2 has been applied.

The diaphragm 8 does not experience as strong a bending in the bordering regions, as is to be gathered from FIG. 4. The same result can be obtained if, for example only the liquid 14 is a rheological liquid, since it will likewise scarcely change its viscosity in the central filter region, because of the weak field applied there. As a result, outflow under pressure is easier, because the viscosity is higher in the bordering regions and it is therefore not possible to displace the liquid therefrom, or only scarcely so.

The result of this displacement of liquid is that the condition of the stratified liquids 13, 14 differs locally. Thus, if, for example, the liquid 13 absorbs radiation only weakly, while the liquid 14 absorbs radiation strongly, because of the number of absorbing elements respectively introduced therein, then little X-ray absorption takes place in the central region, whereas in the edge regions, the absorption behavior is correspondingly stronger. In other words, it becomes possible to vary the absorption characteristics locally by utilizing the electrodes to shift the strongly absorbing liquid 14 from the central region to the peripheral regions and thereby achieve exactly the desired intensity characteristic described in connection with FIG. 1.

The above description of the preferred embodiments has been given by way of example. From the disclosure given, those skilled in the art will not only understand the present invention and its attendant advantages, but will also find apparent various changes and modifications to the structures disclosed. It is sought, therefore, to cover all such changes and modifications as fall within the spirit and scope of the invention, as defined by the appended claims, and equivalents thereof.

What is claimed is:

1. A filter for absorbing X-rays, comprising:

a housing;

a controllable matrix, arranged on said housing, for generating a force field;

a first chamber and a second chamber separated in a sealed fashion from one another in said housing by means of a flexible diaphragm; and a first liquid and a second liquid located respectively in said first chamber and said second chamber, wherein said first liquid and said second liquid differ in their X-ray absorption characteristics, wherein at least one of said liquids is a rheological liquid having a rheological characteristic dependent upon the force field, and wherein at least a minimum pressure is applied to at least one of said liquids; and wherein application of the field generated by said matrix acts on said Theological liquid to adjust a thickness ratio of said first liquid to said second liquid across said diaphragm.

2. The filter as claimed in claim 1, wherein:

said matrix varies the field along a surface of said diaphragm; and the thickness ratio varies along the surface of said diaphragm substantially in accordance with the varying field.

3. The filter as claimed in claim 1, wherein both said first liquid and said second liquid are Theological liquids.

4. The filter as claimed in claim 1, further comprising:

a first liquid reservoir and a second liquid reservoir connected said first chamber and said second chamber, respectively.

5. The filter as claimed in claim 1, further comprising:

a pump connected upstream of one of said chambers, said pump supplying the pressure applied to said liquid located in said one chamber.

6. The filter as claimed in claim 1, wherein said diaphragm is arranged in said housing to separate said first chamber and said second chamber into chambers that differ in size at least when said matrix generates no force field.

7. The filter as claimed in claim 6, wherein said liquid to which the pressure is applied is located in a smaller one of said chambers.

8. The filter as claimed in claim 2, wherein:

the field generated by said matrix is an electric field; and said at least one liquid is an electro-rheological liquid.

9. The filter as claimed in claim 8, wherein said matrix generating the electric field comprises a plurality of pairs of electrodes.

10. The filter as claimed in claim 9, wherein:

one electrode of each said pair of electrodes is associated with said first liquid, and the other electrode of each said pair of electrodes is associated with said second liquid.

11. The filter as claimed in claim 10, wherein said one electrode of each said pair of electrodes is in contact said first liquid and said other electrode of each said pair of electrodes is in contact said second liquid.

12. The filter as claimed in claim 11, wherein:

said electrodes of said matrix that are in contact with said first liquid are arranged as a network of first electrodes having interspaces between said first electrodes for permitting passage of said first liquid between said first electrodes; and said electrodes of said matrix that are in contact with said second liquid are arranged as a network of second electrodes having interspaces between said second electrodes for permitting passage of said second liquid between said second electrodes.

13. The filter as claimed in claim 12, wherein:

said first and said second electrodes are arranged on a first substrate and a second substrate, respectively; and the interspaces are formed by perforations in said first and second substrates.

14. The filter as claimed in claim 9, wherein each of said electrodes has a surface area less than 1 $cm^2$.

15. The filter as claimed in claim 2, wherein:

the field generated by said matrix is a magnetic field; and said at least one liquid is a magneto-rheological liquid.

16. The filter as claimed in claim 15, wherein said matrix generating the magnetic field comprises a plurality of coils.

17. The filter as claimed in claim 16, wherein said plurality of coils are associated with said rheological liquid.

18. The filter as claimed in claim 17, wherein said plurality of coils are in contact with said rheological liquid.

19. The filter as claimed in claim 18, wherein:

said coils that are in contact with said rheological liquid are arranged as a network of coils having interspaces between said coils for permitting passage of said rheological liquid between said coils.

20. The filter as claimed in claim 19, wherein said coils are arranged on a support, and the interspaces are formed by perforations in said support.

21. The filter as claimed in claim 16, wherein a cross-sectional area enclosed by each of said coils is less than 1 $cm^2$.

22. The filter as claimed in claim 1, wherein said housing is constructed of a material that substantially shields the field generated by said matrix from areas external to said housing.

23. A medical X-ray machine comprising:

an X-ray source for emitting X-rays along a radiation path;

a filter disposed in the radiation path;

an object plane disposed in the radiation path downstream of said filter; and an X-ray detector disposed in the radiation path downstream of said object plane;

wherein said filter comprises:

a matrix of elements for generating a force field;

a first chamber containing a first, rheological liquid having a first X-ray absorption characteristic;

a second chamber containing a second liquid having a second X-ray absorption characteristic differing from the first X-ray absorption characteristic;

a flexible diaphragm impermeable to said first and said second liquids and forming a partition between said first chamber and said second chamber;

a pressure source connected to at least one of said first and said second chambers for applying at least a minimum pressure to said liquid contained in said chamber connected to said pressure source.

24. The X-ray machine as claimed in claim 23, wherein:

said matrix of elements and said diaphragm each extends substantially across the radiation path;

said second chamber is disposed either upstream or downstream of said first chamber;

said matrix of elements is configured to generate the force field as a plurality of localized fields that vary respectively in strength across the radiation path; and said diaphragm is sufficiently flexible to alter shape substantially in accordance with the respective strengths of the plurality of localized fields.

25. The X-ray machine as claimed in claim 24, wherein said elements are electrodes and said rheological liquid is an electro-rheological liquid.

26. The X-ray machine as claimed in claim 24, wherein said elements are magnetic coils and said Theological liquid is a magneto-rheological liquid.

* * * * *